United States Patent [19]

Cowger et al.

[11] Patent Number: 5,010,354

[45] Date of Patent: Apr. 23, 1991

[54] INK JET PEN WITH IMPROVED VOLUMETRIC EFFICIENCY

[75] Inventors: Bruce Cowger; John H. Dion; William E. Peters, all of Corvallis, Oreg.

[73] Assignee: Hewlett-Packard Company, Palo Alto, Calif.

[21] Appl. No.: 442,746

[22] Filed: Nov. 28, 1989

[51] Int. Cl.[5] ..... B41J 2/175

[52] U.S. Cl. ..... 346/140 R

[58] Field of Search ..... 346/140 PD

[56] References Cited

U.S. PATENT DOCUMENTS 4,509,062 4/1985 Low et al. .

4,771,295 9/1988 Baker et al. .

4,791,438 12/1988 Hanson et al. ..... 346/140 PD 4,794,409 12/1988 Cowger et al. ..... 376/140 PD

*Primary Examiner*—George H. Miller, Jr.

[57] ABSTRACT

An ink jet pen (10) having a primary ink reservoir (12) connected to a printhead (16) and to a chamber (18) containing a capillary volume element (20). The pressure within the capillary element (20) is greater normal sub-atmospheric pressure within the ink reservoir (12) but is less than atmospheric pressure. In operation within a normal ambient pressure and temperature range, ink from the reservoir (12) does not enter the capillary volume element (20). Outside of the normal range, the increased pressure within the reservoir (12) causes ink to be drawn into the capillary volume element (20). This enables the pressure of the reservoir (12) to remain substantially constant so that ink is not ejected from the orifice plate of the printhead (16). As the pressure or temperature falls again into the normal range, the ink is drawn back into the primary ink reservoir (12) from the capillary volume element (20).

16 Claims, 2 Drawing Sheets

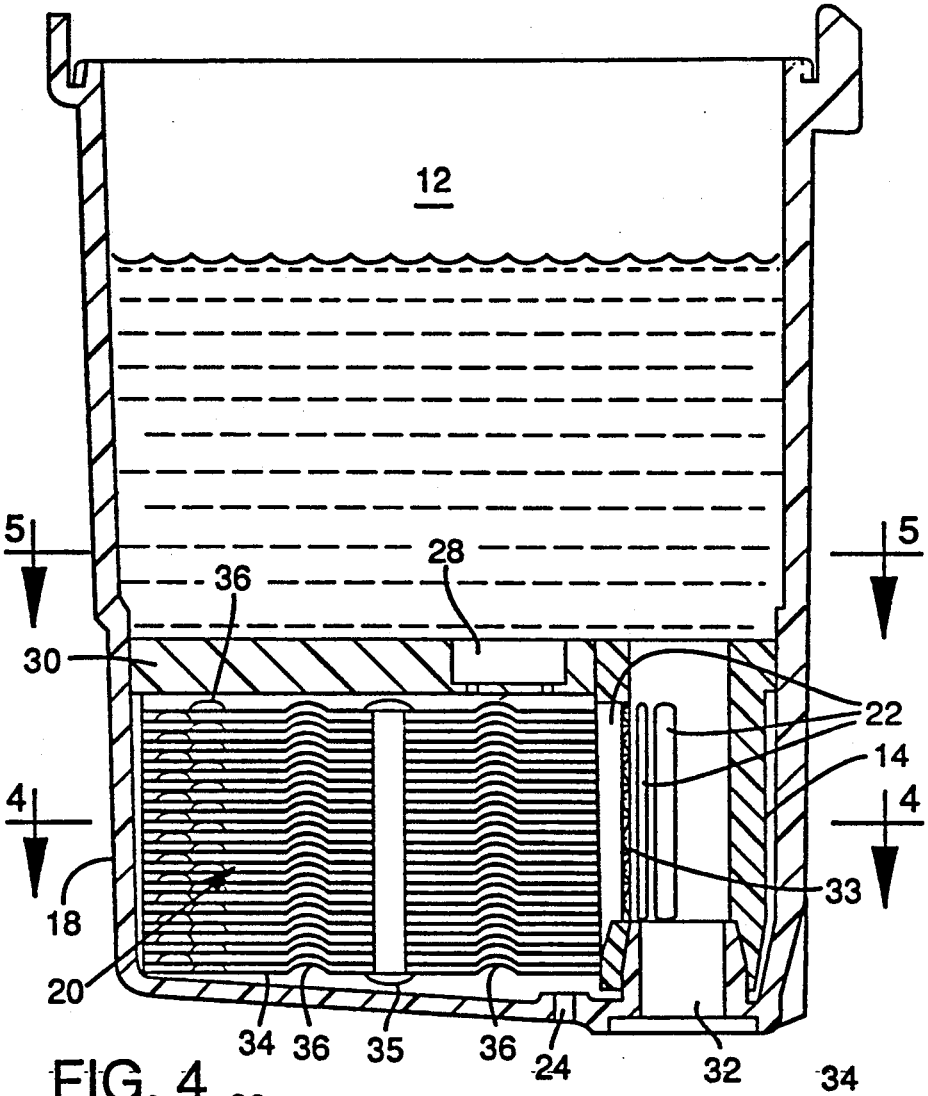
FIG. 3
FIG. 4
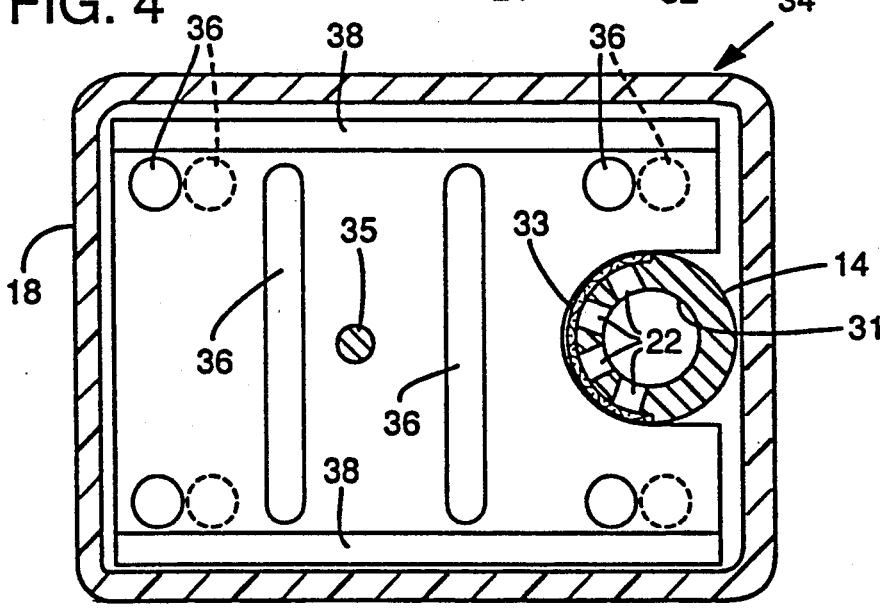
FIG. 6
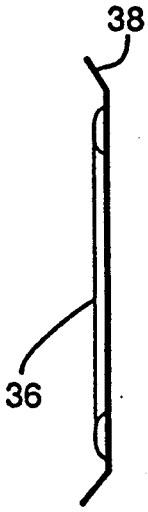

INK JET PEN WITH IMPROVED VOLUMETRIC EFFICIENCY

BACKGROUND OF THE INVENTION

This invention relates generally to ink jet printing systems. More particularly, this invention relates to an ink jet pen with improved volumetric efficiency that maintains its performance in pressure and temperature extremes.

Ink jet pens comprise generally two components: a printhead and an ink delivery system for delivering ink to the printhead. In the manufacture of ink jet pens, various approaches have been taken to insure that a substantially constant back pressure (sub-atmospheric pressure) is provided to the printhead of the pen as the ink is depleted during an ink jet printing operation. In this manner, the size of the ink drops ejected from the orifice plate of the printhead remain constant during ink depletion. This back pressure also prevents leakage of ink from the orifice plate when an orifice is not firing.

A concern that must be addressed, however, is internal pressure changes in the pen. The internal pressure in the ink reservoir may increase relative to the ambient pressure because of high altitude transport or heating of the pen during operation. The back pressure at the printhead may thus decrease to the point that the ink can drool or even be ejected from the pen.

One approach to maintaining a substantially constant back pressure in the ink reservoir in the face of pressure changes is disclosed in U.S. Pat. No. 4,509,062 to Low et al. The described approach, while highly satisfactory and unique in most respects, nevertheless requires a collapsible bladder in order to maintain a substantially constant back pressure in the ink reservoir over a desired range of pressure and temperature. The collapsible bladder impairs the volumetric efficiency of the pen, defined as the volume of the ink jet pen divided by the volume of deliverable ink.

Another approach to storing ink in an ink reservoir is disclosed in U.S. Pat. No. 4,771,295 to Baker, assigned to the present assignee. In this approach, a reticulated polyurethane foam is placed in the ink reservoir as an ink storage medium for both black and color pens. This provides several new and useful improvements. However, the porous storage medium in the ink reservoir reduces the volume of ink therein. This approach thus offers negligible improvement in volumetric efficiency compared to the approach of Low.

To improve volumetric efficiency while maintaining substantially constant back pressure across of range of temperature and pressure, several other techniques have been tried. U.S. Pat. No. 4,794,409 to Cowger et al. describes an ink jet pen having a primary ink reservoir, a catch basin and an ink jet printhead all interconnected by a porous transfer member such as foam. As pressure within the primary ink reservoir changes relative to ambient pressure, it is intended that ink be drawn through the foam back and forth between the primary reservoir and the catch basin. U.S. Pat. No. 4,791,438 to Hanson et al. describes an ink jet pen having a primary ink reservoir, a secondary ink reservoir and a capillary member connecting the two reservoirs. The disclosed structure is also intended to draw ink through the capillary member back and forth between the primary reservoir and the secondary reservoir. Both of these devices, however, have limitations as well as advantages. The limitations stem in part from having a catch basin that is normally empty and not in fluid communication with the primary ink reservoir.

SUMMARY OF THE INVENTION

An object of the invention, therefore, is to maintain a substantially constant back pressure in an ink jet pen in the face of temperature and pressure changes.

Another object of the invention is to provide an ink jet pen with such constant back pressure and improved volumetric efficiency.

In accordance with the invention, an ink jet pen comprises an ink reservoir for supplying ink to a printhead and a chamber adjacent to the ink reservoir. Contained within the chamber is a capillary volume element in fluid communication with the ink reservoir. The capillary volume element maintains pressure at the printhead at less than ambient pressure by supplying ink to and accepting ink from the reservoir in response to a change in pressure within the reservoir. Such pressure changes may occur, for example, from heating of the pen or high altitude transport.

In one aspect of the invention, the capillary element is constructed so that the pressure within the element (capillarity) is less than ambient. In another aspect, the pen may include a bubble generator for allowing ink into the reservoir in response to a decrease of pressure therein from ink being ejected through printing. For efficient pen operation, the bubble generator and capillary volume element may be combined in a common design.

The foregoing and additional objects, features and advantages of the present invention will be more readily apparent from the following detailed description, which proceeds with reference to the accompanying drawings.

BRIEF DESCRIPTION OF THE DRAWINGS

FIG. 3 is sectional view of one embodiment of the ink jet pen of FIG. 1 with the ink partially depleted.

FIG. 4 is a top view of the pen of FIG. 3 taken along line 4—4 of FIG. 3.

FIG. 6 is a rear view of a capillary plate shown in FIG. 4.

DETAILED DESCRIPTION

Figure 1:
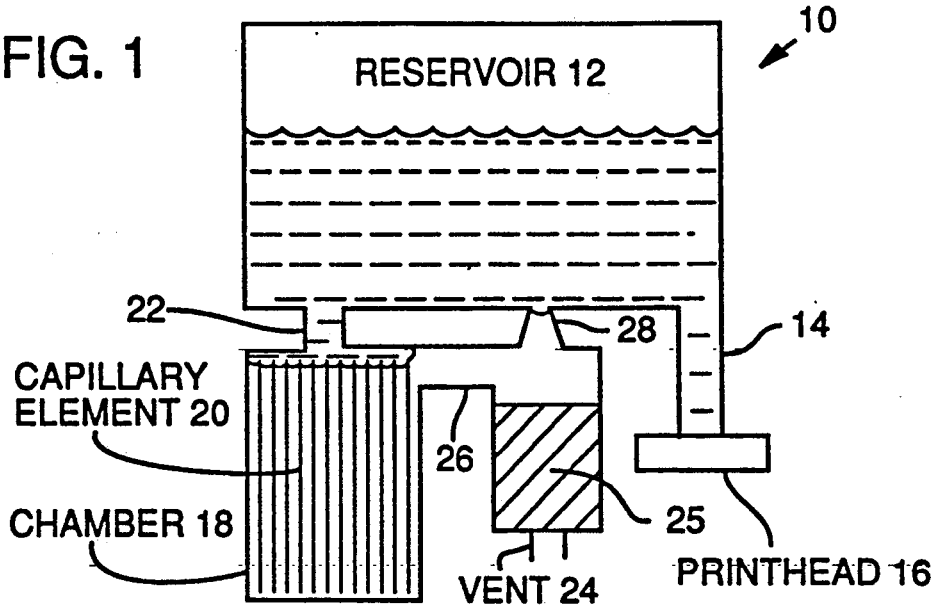
FIG. 1 is a block diagram of an ink jet pen according to the present invention.

FIG. 1 shows a block diagram of an ink jet pen 10 according to the invention. The pen 10 includes a primary ink reservoir 12 for supplying ink through a conduit 14 to a printhead 16. Printhead 16 is of a conventional design commonly found in ink jet pens, such as described in the *Hewlett-Packard Journal,* Vol. 36, No. 5 (May 1985), incorporated herein by reference. Immediately below the left portion of the reservoir 12 is a chamber 18 that contains a capillary volume element 20. Because of the presence of element 20, the reservoir 12 and chamber 18 are in fluid communication through a port 22. The port 22 allows ink to pass back and forth between the reservoir and capillary element 20 in a manner to be explained. The function of the capillary element 20 is to maintain pressure within the ink reservoir 12 as measured at the printhead at less than ambient pressure. The element 20 does this by supplying ink to and accepting ink from the reservoir in response to a change in pressure within the reservoir relative to ambient pressure. For example, such a pressure change may come from heating of air within the ink reservoir, with a consequent increase in pressure relative to ambient pressure. Unless such a pressure increase is compensated for, the ink within the reservoir may leak through or be forcibly ejected from the orifice plate of the printhead 16.

To the right of the chamber 20 is shown a vent 24 with an optional ink filter such as foam 25 for venting air into the reservoir 12. The vent 24 is connected to the chamber 18 by a port 26 and to the primary ink reservoir 12 by a port 28. The foam 25 is present to insure that any ink that might be free within the chamber 18 does not leak through the vent 24. The size of port 26 is not critical, so long as air at atmospheric pressure can be freely drawn into or be discharged from the capillary element 20. The port 28, however, is a bubble generator which allows air from the vent 24 into the reservoir 12 to replace ink discharged through the printhead 16. The dimensions of a bubble generator are a design feature, as will be described.

In operation of the pen 10, the printhead 16 acts as a small pump, capable of pumping several cubic centimeters of ink per minute. While pumping the printhead 16 exerts a suction of several inches of water upon the ink delivery system, which includes the interconnected reservoir 12, conduit 14, chamber 18, capillary element 20 and vent 24. FIG. 1 shows the ink delivery system in its quiescent state, with the internal, sub-atmospheric pressure of the partially depleted reservoir 12 within a normal range. The air-ink interface is at the boundary of the capillary element 20. There is no ink in the chamber 18 or capillary element 20 because its capillarity is less than the pull of the quiescent back pressure. The capillarity of the element 20 is set between the pressure within the ink reservoir as measured at the printhead 16 and ambient pressure. In the event of environmental stress such as a lowering of ambient pressure or a thermally induced expansion of the reservoir air, ink will first be drawn into the chamber 18 before it would be ejected through the orifice plate of the printhead 16. The ink in the reservoir 12 also covers the bubble generator 28, and its interface (meniscus) to ambient air is within the generator.

As the printhead 16 pumps ink out of the reservoir 12, the air pressure within the reservoir drops as the air volume increases. The bubble generator meniscus (or menisci if there are several generators) draws further back into the ink reservoir as the ambient air pressure becomes relatively greater. When the reservoir pressure decreases to equal the bubble pressure of the weakest bubble generator, the meniscus suddenly swells into a bubble whose connection to the meniscus is quickly broken by surface tension. The freed bubble then rises by buoyancy forces to the top of the reservoir, where it joins other air that may be present.

The back pressure of the pen 10 is determined by the size of bubble generators 28. The bubble generators admit air to the reservoir 12 at a pressure equal to ambient pressure less the generator's bubble pressure. To understand the mechanism of pressure reduction, consider that the internal pressure of an air bubble surrounded by ink is higher than the static pressure of the nearby ink by an amount $$2 * \gamma/r$$

where $\gamma$ is the surface tension of the ink and r is the bubble radius. Therefore the pressure on the reservoir side of the bubble generator 28 must be lower than pressure on the chamber side for air to be injected in bubble form into the ink reservoir. This differential pressure is the bubble pressure of the generator 28 and depends on the diameter of the opening therein. This diameter is related to the radius r of the resulting bubbles, although other empirical factors are also included such as the surface tension of the ink.

At the formation of each bubble, a small volume of air rushes into the reservoir 12 to slightly raise the reservoir pressure. If the printhead 16 continues to pump ink out of the reservoir 12, the back pressure within the reservoir will again increase until the generator 28's bubble pressure is once more reached. The back pressure within the reservoir 12 is therefore substantially constant, with the pressure variation minimized by design of the bubble generator 28. A desired back pressure within the reservoir 12 is 4.5 inches of water. This can be achieved by a generator design with knowledge of the surface tension of the ink.

As an air bubble breaks off from the bubble generator 28, ink rushes in to replace the air. The ink's momentum may cause it to be ejected through the bubble generator and into the vent 24 (or chamber 18 if the bubble generator is located adjacent to the basin). If the ejected ink contacts a wettable solid surface, the ink may attach to the surface and form a capillary bridge from the generator 28 to the surface. This bridge may interfere with the formation of the next air bubble and thereby lead to pressure spikes that significantly lower the nominal back pressure. To avoid that possibility, it is preferred that such solid surfaces not be present immediately outside the bubble generator 28.

Figure 2:
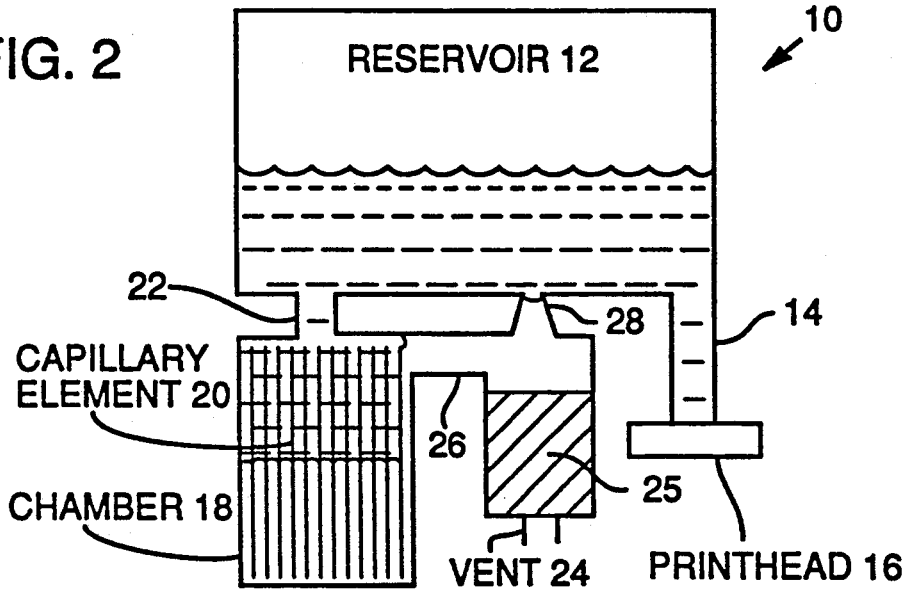
FIG. 2 is another view of the pen in FIG. 1 after the air pressure within the primary ink reservoir has risen relative to ambient pressure to force ink into a capillary volume element.

If the air pressure within a partially depleted reservoir 12 rises relative to the ambient pressure, the back pressure drops. This may occur, for example, if the temperature of the air within the reservoir increases or if the ambient pressure decreases relative to the reservoir pressure, such as at high altitude transport. FIG. 2 illustrates such a circumstance. The capillarity of the capillary element 20 is several inches of water, less than the nominal back pressure. If the air pressure within the reservoir 12 increases, however, to equal the capillarity, ink will be drawn into the element 20 through the port 22, as shown, rather than be leaked through orifice plate of the printhead 16. As ink enters the capillary element 20, air is discharged from it through port 26. The capillarity of the element 20 is set so that there is still sufficient sub-atmospheric pressure on the ink at the orifice plate of the printhead 16 when the ink-ambient air interface is within the capillary element 20. In this way the pressure is maintained within the reservoir 12 measured at the printhead 16 at less than ambient pressure over a predetermined range of pressure and temperature.

In contrast to the ink jet pens disclosed in U.S. Pat. Nos. 4,794,409 and 4,791,438, the ink that flows into the chamber 18 maintains fluid communication with ink in the reservoir 12 because of the capillary element 20 contained within the chamber. In the prior pens, the capillary material did not fill the chamber. It was found that as ink flowed into the chamber, ink could drool from the printhead orifices if they were contaminated with paper dust or dried ink.

When the air pressure within the reservoir 12 subsides, ink is drawn back in to the reservoir from the capillary element 20 through the port 22. Element 20 in turn draws air into it to replace the ink returned to the ink reservoir 12. This fluid communication with the chamber 18 acts to maintain the back pressure within the reservoir at a desired range while preserving the ink for printing. Thus, during temperature and altitude cycles, ink is moved back and forth between the reservoir 12 and capillary volume element 20 to maintain a sub-atmospheric pressure at the orifice plate of the printhead 16.

Figure 5:
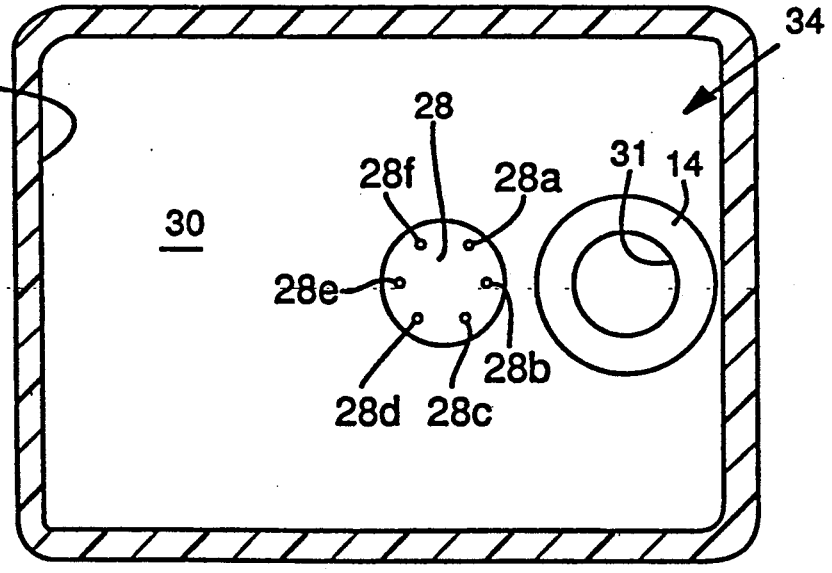
FIG. 5 is a top view of the pen of FIG. 3 taken along line 5—5 of FIG. 3.

FIGS. 3–6 illustrate one of many possible embodiments of an ink jet pen according to the invention. For clarity, the same numerals are employed in FIGS. 3–6 as are employed in FIGS. 1–2 for equivalent elements. An inner wall 30 separates the reservoir 12 from the chamber 18. As best seen in FIG. 5, the wall 30 defines a plurality of openings 28*a*–28*f* as bubble generators for allowing air to enter the reservoir 12 in the manner described. Wall 30 also defines an opening 31 which accepts a standpipe 14 as the conduit between a printhead 16 (not shown) and the reservoir 12. The printhead connects to opening 32 in FIG. 3. Within the standpipe 14 are a series of narrow vertical slits 22 that form the port between the reservoir 12 and capillary volume element 20. Between the slits 22 and element 20 is a capillary screen 33 that prevents air from entering the standpipe 14 and reservoir 12. The screen 33 assists in the circumstance when the capillary element is normally empty of ink, as shown in FIG. 3. Ink, when entering the capillary volume element 20 in response to increased air pressure within reservoir 12, flows through the screen 33 and moves to the left. When the air pressure decreases, the ink moves out of the element 20 to the right and back into the reservoir 12.

As illustrated in FIGS. 3, 4 and 6, the capillary volume element includes a plurality of parallel plates 34 set at a constant pitch and held together by a rivet 35. The capillary volume is constructed according to known techniques to have a specified capillarity throughout. Spacing is maintained between the plates by offset small and large dimples 36 and fins 38. The capillarity may be constant throughout or it may vary. The only requirement is that the capillarity be sufficient to control substantially all the ink that enters the capillary volume so that the ink can be withdrawn into the reservoir 12. The plate material should thus be sufficiently wettable over a long period of time so that the capillarity may be maintained. Suitable materials include metal or plastic with surface energy over 40 dynes/cm.

The vent 24 appears at the bottom of chamber 18. No separate port 26 is needed in this embodiment. Air for the bubble generator 28 flows directly through the chamber and around the capillary plates 34.

The disclosed parallel plate embodiment with the port 22 defined in the standpipe 14 is only one possible arrangement for the capillary volume element 20. If the port 22 faces the plates 34, slits may be cut within each plate to allow ink to move between the plates. And as will be appreciated by those skilled in the art, similar capillary action within chamber 18 may be achieved with a number of equivalent structures. These include but are not limited to folded ribbons or honeycombs of material, interdigitated fins, spiral forms, cylinders, glass beads, and uniform cellular foam.

Those skilled in the art will also appreciate that any of the aforementioned designs can be manufactured with ink present in the capillary volume element 20 as well as the reservoir 12. This provides additional ink for the same size pen.

Having described and illustrated the principles of our invention with reference to a preferred embodiment, it should be apparent that the invention can be modified in arrangement and detail without departing from such principles. For example, the relative locations of the various elements of the invention are not restricted to the disclosed positions, but may be arranged as desired. The chamber 18, for instance, could be defined within a larger, rectangular ink reservoir. Separate vents for each of the chamber 18 and bubble generator 28 may be preferred in some pen designs. The preferred embodiment should therefore be considered illustrative only and not as limiting the scope of the invention. Our invention includes any embodiment as may come within the scope and spirit of the following claims.

We claim:

1. An ink jet pen, comprising:

an ink reservoir for supplying ink to a printhead;

a chamber adjacent to the ink reservoir; and capillary volume means contained within the chamber comprising a plurality of spaced plates, the capillary means being in fluid communication with the ink reservoir for maintaining pressure at the printhead at less than ambient pressure, the capillary means supplying ink to and accepting ink from the reservoir in response to a change in pressure within the reservoir.

2. The ink jet pen of claim 1 wherein the capillary means is constructed so that the pressure within the means is less than ambient.

3. The ink jet pen of claim 1 wherein the pressure within the capillary means is substantially uniform throughout the means.

4. The ink jet pen of claim 1 including a bubble generator for allowing air into the ink reservoir in response to a decrease in pressure therein.

5. The ink jet pen of claim 1 including a capillary screen between the capillary means and the ink reservoir.

6. The ink jet pen of claim 1 including a conduit between the ink reservoir and the printhead and a port within the conduit for allowing fluid communication between the capillary means and the ink reservoir.

7. The ink jet pen of claim 1 including a vent in communication with the chamber for allowing air to be drawn into and discharged from the capillary means.

8. The ink jet pen of claim 7 including a bubble generator, wherein the vent provides air to the bubble generator through the chamber.

9. The ink jet pen of claim 7 including a filter for preventing ink within the chamber from leaking through the vent.

10. An ink jet pen, comprising:

an ink reservoir for supplying ink to a printhead;

a chamber adjacent to the ink reservoir;

means for allowing air into the reservoir as ink is ejected through the printhead;

capillary means within the chamber and in fluid communication with the ink reservoir for maintaining pressure at the printhead at less than ambient pressure comprising a plurality of spaced plates, the capillary means supplying ink to and accepting ink from the reservoir in response to a change in pressure within the reservoir; and means for allowing air into and out of the chamber.

11. The ink jet pen of claim 10 wherein the capillary means is constructed to maintain fluid communication between the reservoir and the capillary means as substantially all ink within the capillary means is supplied to the reservoir.

12. The ink jet pen of claim 11 wherein the pressure of the capillary means is substantially uniform throughout the means.

13. The ink jet pen of claim 10 wherein the means for allowing air into the reservoir comprises a bubble generator.

14. An ink jet pen, comprising:

an ink reservoir for supplying ink to a printhead, the ink reservoir including a conduit operatively connected to the printhead;

a chamber adjacent to the ink reservoir;

a vent for allowing air into the chamber;

a bubble generator for allowing air into the reservoir as ink is ejected through the printhead;

a port connecting the reservoir to the chamber; and a capillary element of known capillarity filling the chamber and in fluid communication with the ink reservoir through the port for maintaining pressure at the printhead at less than ambient pressure, the capillary element supplying ink to and accepting ink from the reservoir in response to a change in pressure within the reservoir.

15. The ink jet pen of claim 14 wherein the bubble generator is in communication with the chamber to receive air from the vent.

16. An ink jet pen, comprising:

an ink reservoir for supplying ink to a printhead;

a chamber adjacent to the ink reservoir;

a vent for allowing air into the chamber;

a first port connecting the reservoir to the vent;

a second port separate from the first port connecting the reservoir to the chamber; and a capillary element contained within the chamber and in fluid communication with the ink reservoir for maintaining pressure at the printhead at less than ambient pressure, the capillary element supplying ink to and accepting ink from the reservoir in response to a change in pressure within the reservoir.

* * * * *